US012654077B2

(12) United States Patent
Voorhees

(10) Patent No.: US 12,654,077 B2
(45) Date of Patent: Jun. 16, 2026

(54) METHOD OF FABRICATING A GOLF BALL MARKER HAVING MATCHING INDICIA WITH CLOTHING

(71) Applicant: Connie M. Voorhees, Sanford, FL (US)

(72) Inventor: Connie M. Voorhees, Sanford, FL (US)

( * ) Notice: Subject to any disclaimer, the term of this patent is extended or adjusted under 35 U.S.C. 154(b) by 105 days.

(21) Appl. No.: 18/102,242

(22) Filed: Jan. 27, 2023

(65) Prior Publication Data

US 2023/0241467 A1 Aug. 3, 2023

Related U.S. Application Data

(60) Provisional application No. 63/306,321, filed on Feb. 3, 2022.

(51) Int. Cl.
*A63B 57/30* (2015.01)

(52) U.S. Cl.
CPC ..... *A63B 57/353* (2015.10); *A63B 2209/10* (2013.01)

(58) Field of Classification Search
CPC ..... A63B 57/353; A63B 2209/00
See application file for complete search history.

(56) References Cited

U.S. PATENT DOCUMENTS 1,830,936 A 11/1931 Faith
5,282,616 A 2/1994 Stacavich-Notaro
5,295,683 A * 3/1994 Tate ..... A63B 57/353 473/406
5,320,345 A * 6/1994 Lai ..... A63B 41/08 473/603
5,529,299 A * 6/1996 Bellagamba ..... A63B 57/20 473/285
5,898,946 A 5/1999 Keating et al.
(Continued)

FOREIGN PATENT DOCUMENTS

KR 200427077 Y1 * 9/2006
KR 20080004286 U * 10/2008
(Continued)

OTHER PUBLICATIONS

Periphery Definition.*

*Primary Examiner* — Eugene L Kim
(74) *Attorney, Agent, or Firm* — ALLEN, DYER, DOPPELT + GILCHRIST, P.A.

(57) ABSTRACT

A method of fabricating a golf ball marker having matching indicia with clothing includes creating a digital image of a portion of clothing having a unique design, transferring the digital image on to a photographic material, and forming a disc of material from the photographic material so that the unique design is displayed thereon. The method also includes securing the disc of material to a base of the golf ball marker so that the golf ball marker has matching indicia with the clothing. In addition, the method may include providing a Camera to create the digital image of a portion of the clothing having a unique design, providing a printer to transmit the digital image to the photographic material, and providing a die press to form the disc of material, where the disc of material is secured to the base of the golf ball marker using adhesive.

12 Claims, 2 Drawing Sheets

(56) References Cited

U.S. PATENT DOCUMENTS

| | | | | | |
|---|---|---|---|---|---|
| 5,951,359 | A * | 9/1999 | Prakopcyk | A63H 27/10 | 446/226 |
| 6,077,174 | A | 6/2000 | Noritake | | |
| 6,386,995 | B1 * | 5/2002 | Jastram | A63B 57/207 | 473/406 |
| 6,422,955 | B1 * | 7/2002 | Lopez | A42B 1/24 | 473/406 |
| 6,820,282 | B1 * | 11/2004 | England | A41D 19/002 | 2/161.1 |
| 8,388,469 | B1 * | 3/2013 | Hawthorn | A63B 57/353 | 473/406 |
| 2002/0174478 | A1 * | 11/2002 | Litke | A41D 19/0051 | 2/161.4 |
| 2003/0166423 | A1 * | 9/2003 | Rao | A63B 57/353 | 473/406 |
| 2005/0230909 | A1 * | 10/2005 | Gallant | A63F 9/10 | 273/156 |
| 2006/0063614 | A1 * | 3/2006 | Bellagamba | A63B 57/207 | 473/406 |
| 2009/0156332 | A1 | 6/2009 | Smith | | |
| 2011/0061207 | A1 | 3/2011 | Forbes | | |
| 2013/0036767 | A1 * | 2/2013 | Mehta | A44C 13/00 | 63/23 |
| 2015/0040291 | A1 * | 2/2015 | Cho | A42B 1/24 | 473/406 |

FOREIGN PATENT DOCUMENTS

| | | | | | |
|---|---|---|---|---|---|
| KR | 20210122976 | A | * | 10/2021 | |
| KR | 20220000804 | U | * | 4/2022 | |
| WO | WO-2006080859 | A1 | * | 8/2006 | A45F 5/02 |

* cited by examiner

METHOD OF FABRICATING A GOLF BALL MARKER HAVING MATCHING INDICIA WITH CLOTHING

RELATED APPLICATIONS

The present invention is related to U.S. Provisional Patent Application Ser. No. 63/306,321 filed Feb. 3, 2022, the entire contents of which are incorporated herein by reference.

FIELD OF THE INVENTION

The present invention relates to the field of golf equipment, and more particularly to a method of fabricating a golf ball marker having matching indicia with clothing.

BACKGROUND

Golf players typically mark the ball placement on a golf green with a ball marker. The ball marker allows the player to mark the location and pick up their ball so that they can clean the ball. In addition, a ball may be in the way of another player's ball on the green and need to be moved. The ball is picked up and replaced with the ball marker so the player can putt to the hole.

A ball marker is defined as "an artificial object when used to mark the spot of a ball to be lifted, such as a tee, a coin, an object made to be a ball-marker or another small piece of equipment." In compliance with the rules, golfers use a variety of styles of ball markers. One of the most common ball markers is a plastic or metal disc. Some golfers may use a coin or poker chip or other objects with different designs, sizes and styles.

Sometimes golfers may be unable to determine Which golf ball marker belongs to which golfer after placed on the green. This can cause confusion to sort out and delay game play. Accordingly, there is a need for an improved golf ball marker that efficiently identifies the owner of the golf ball marker.

SUMMARY

A method of fabricating a golf ball marker having matching indicia with clothing is disclosed. The method includes creating a digital image of a portion of clothing having a unique design, transferring the digital image on to a photographic material, and forming a disc of material from the photographic material so that the unique design is displayed thereon. The method also includes securing the disc of material to a base of the golf ball marker so that the golf ball marker has matching indicia with the clothing.

The method may include using the golf ball marker when a golfer is wearing the clothing having matching indicia to visually identify who the golf ball marker belongs to when playing a game of golf. In addition, the method may include providing a camera to create the digital image of a portion of the clothing having a unique design, providing a printer to transmit the digital image to the photographic material, providing a die press to form the disc of material, and any combination thereof.

The method may also include using an adhesive to secure the disc of material to the base of the golf ball marker or using a hook and loop material to secure the disc of material to the substantially top surface of the golf ball marker. The golf ball marker may include a post extending away from the base that is configured to secure the golf ball marker to a golf green surface.

The method may also include forming a plurality of discs from the photographic material so that the unique design is displayed thereon. In addition, the method may include transmitting the digital image of the portion of clothing having the unique design to a remote location over a network to transfer the digital image on to the photographic material.

In another particular aspect, a golf ball marker kit for fabricating a golf ball marker having matching indicia with clothing is disclosed. The kit includes a golf ball marker having a base, wherein the base has a substantially circular top surface. The kit also includes photographic material configured to receive thereon a digital image of a portion of clothing having a unique design. The photographic material is configured to be formed into at least one disc and secured to the substantially circular top surface of the golf ball marker so that the golf ball marker has matching indicia with the clothing. The golf ball marker is configured to be used when a golfer is wearing the clothing having matching indicia to visually identify who the golf ball marker belongs to when playing a game of golf. The photographic material may be configured to have the digital image applied thereon by a printer. The kit may also include an adhesive configured to secure the disc to the substantially circular top surface of the golf ball marker.

DETAILED DESCRIPTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
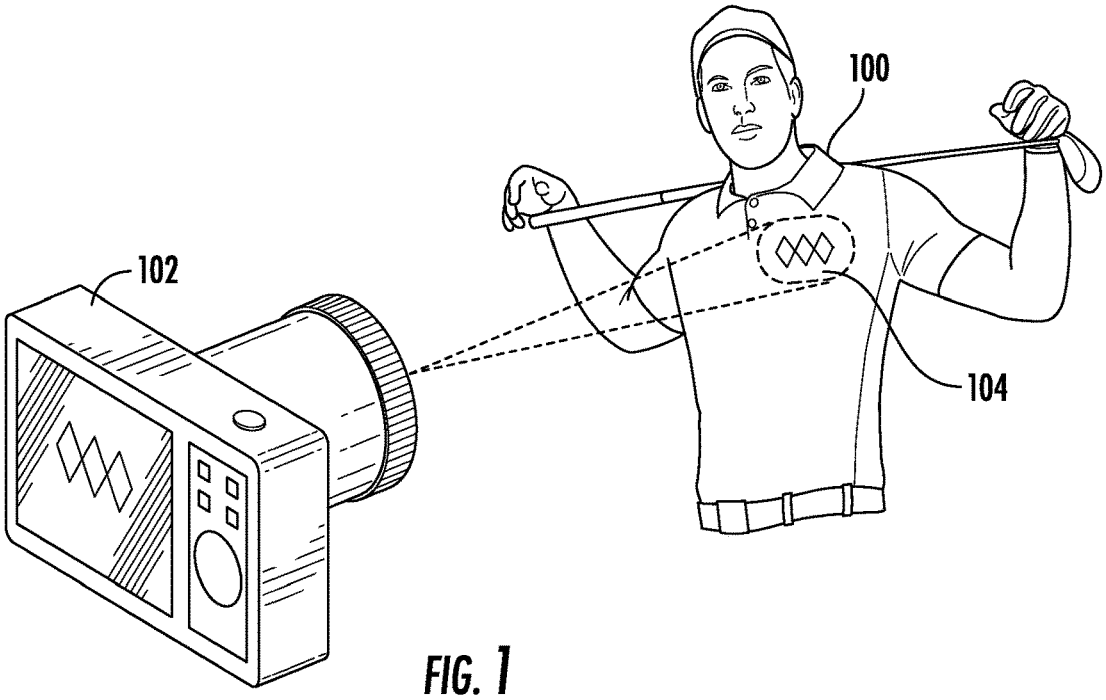
FIG. 1 is a schematic of a camera for creating a digital image of a portion of clothing having a unique design in accordance with various aspects of the disclosure.
Figure 2:
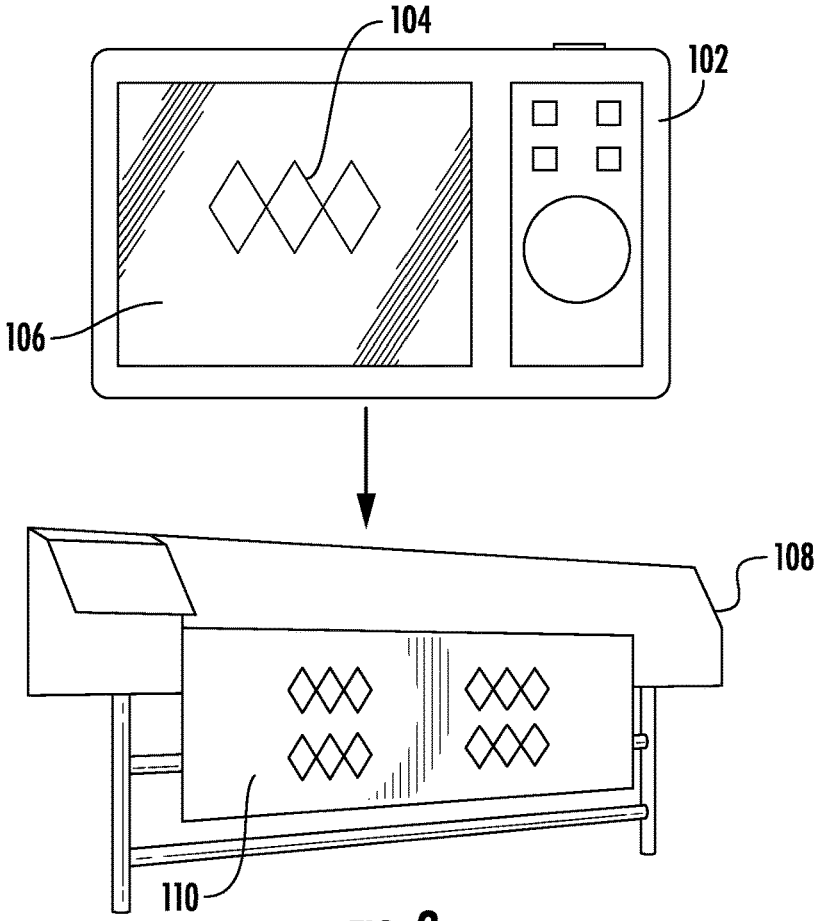
FIG. 2 is a schematic of a printer for transferring the digital image on to a photographic material.

Referring now to FIG. 1, a camera 102 is depicted that can be used to create a digital image of a portion of clothing worn by a golfer 100. The camera 102 takes a digital picture to capture the unique design 104 on the clothing. The digital image 106 having the unique design 104 is transmitted on to a photographic material 110 using a printer 108 (or other similar machine known in the art) as shown in FIG. 2. The photographic material 100 may be sheets of paper, a roll of fabric, or any other similar material that is receptive to ink as those of ordinary skill in the art can appreciate.

Figure 3:
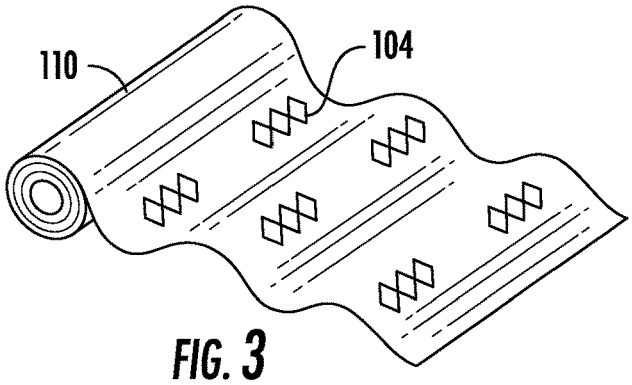
FIG. 3 is a schematic of a roll of the photographic material having the unique design.

For example, a golfer can take a picture of the unique design 104 using their mobile phone and transmit to a remote printer or a local printer to be printed. The size of the photographic material 110 can be any length or width and placed on a roll as shown in FIG. 3, for example.

Figure 4:
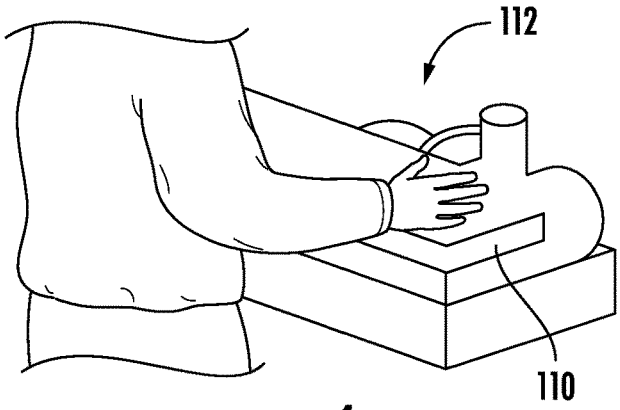
FIG. 4 is a schematic of a die press for forming a disc of material from the photographic material so that the unique design is displayed thereon.
Figure 5:
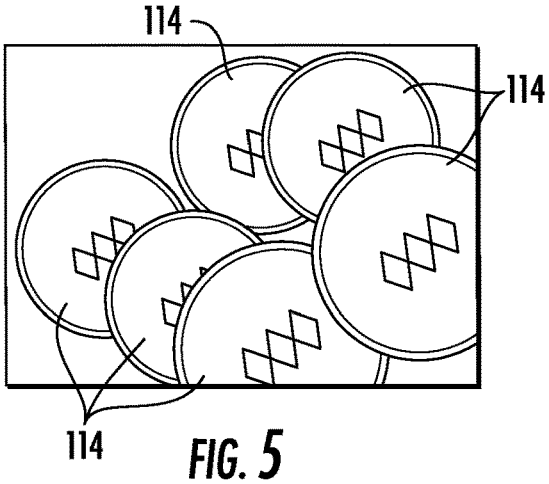
FIG. 5 is a schematic of a plurality of discs of material having the unique design.

The method includes taking that photographic material 110 and forming a disc of material 114 so that the unique design 104 is displayed thereon. The disc 114 may be cut using scissors or a die press 112 as shown in FIG. 4, for example. As those of ordinary skill in the art can appreciate, different methods may be used to form the discs 114 shown in FIG. 5.

Figure 6:
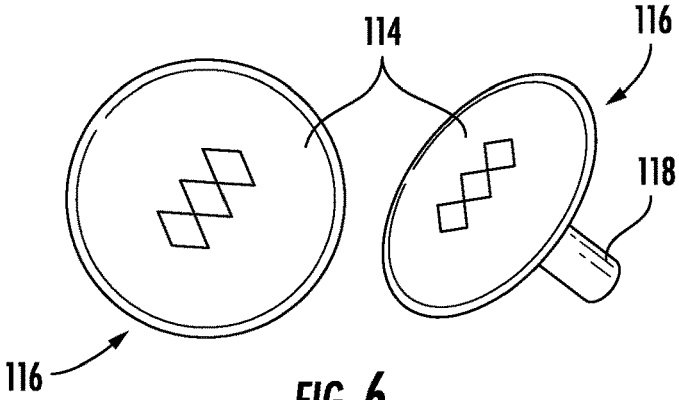
FIG. 6 is a schematic of the disc of material secured to a base of the golf ball marker so that the golf ball marker has matching indicia with the clothing.

The method also includes securing the disc of material 114 to a base 118 of the golf ball marker 116 so that the golf ball marker 116 has matching indicia with the clothing of the golfer 100 as shown in FIG. 6. The disc of material 114 may be secured to the base 118 using adhesive, for example. Accordingly, the golf ball marker 116 can be used when a golfer is wearing the clothing having the matching indicia to visually identify who the golf ball marker belongs to when playing a game of golf. The base 118 may be ferromagnetic and have suitable weight to hold in place on the green. In addition, the base 118 may be attached to a clip that many golfers wear on their headgear that is magnetic.

The digital image 106 having the unique design 104 may also be transmitted directly on to the top of the golf ball marker 116 using the printer 108, by printing, engraving, etching, or forming, for example.

In another aspect, a golf ball marker kit can be provided for a golfer to fabricate their own golf ball marker having matching indicia with their clothing. The kit includes the necessary components for the golfer to fabricate one or more of the golf ball markers that match their clothing. For example, the kit includes a golf ball marker 116 having a base 118, where the base has a substantially circular top surface as explained above. The kit also includes photographic material 110 that is configured to receive thereon a digital image of a portion of clothing having a unique design.

The photographic material 110 is configured to be formed into at least one disc 114 and secured to the substantially circular top surface of the golf ball marker 116 so that the golf ball marker has matching indicia with the clothing. The kit may also include an adhesive configured to secure the disc to the substantially circular top surface of the golf ball marker.

The golfer can follow the method explained above using the components in the kit to fabricate the golf ball marker having matching indicia with their clothing.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A method of fabricating a golf ball marker having matching indicia with clothing, the method comprising:

creating a digital image of a portion of clothing having a unique design;

transferring the digital image on to a photographic material that comprises a flexible material;

forming a disc of material from the photographic material so that the unique design is displayed thereon; and securing the disc of material to a substantially circular top flat surface of a base of the golf ball marker so that the golf ball marker has matching indicia with the clothing, the base comprising a ferromagnetic material;

wherein the disc of material is sized and shaped to match the base so that the disc of material extends continuously over the substantially circular top flat surface and to a periphery of the base and the disc of material being secured to the base using an adhesive applied to the substantially circular top flat surface of the base.

2. The method of claim 1, further comprising using the golf ball marker when a golfer is wearing the clothing having matching indicia to visually identify who the golf ball marker belongs to when playing a game of golf.

3. The method of claim 1 further comprising providing a camera to create the digital image of a portion of the clothing having a unique design.

4. The method of claim 1 further comprising providing a printer to transmit the digital image to the photographic material.

5. The method of claim 1 further comprising providing a die press to form the disc of material.

6. The method of claim 1, further comprising forming a plurality of discs from the photographic material so that the unique design is displayed thereon.

7. The method of claim 1, further comprising transmitting the digital image of the portion of clothing having the unique design to a remote location over a network to transfer the digital image on to the photographic material.

8. A golf ball marker kit for fabricating a golf ball marker having matching indicia with clothing comprising:

a golf ball marker having a base, wherein the base comprising a substantially circular top flat surface; and photographic material configured to receive thereon a digital image of a portion of clothing having a unique design, the photographic material comprising a flexible material;

an adhesive;

wherein the photographic material is configured to be formed into at least one disc and secured to the substantially circular top flat surface of the golf ball marker so that the golf ball marker has matching indicia with the clothing, the base comprising a ferromagnetic material; and wherein the at least one disc of material is sized and shaped to match the base so that the at least one disc of material extends continuously over the substantially circular top flat surface and to a periphery of the base and the at least one disc of material being configured to be secured to the base using the adhesive applied to the substantially top flat surface of the base.

9. The golf ball marker kit of claim 8, wherein the golf ball marker is configured to be used when a golfer is wearing the clothing having matching indicia to visually identify who the golf ball marker belongs to when playing a game of golf.

10. The golf ball marker kit of claim 8, wherein the photographic material is configured to have the digital image applied thereon by a printer.

11. A golf ball marker having matching indicia with clothing comprising:

a golf ball marker having a base, wherein the base having a substantially circular top and the base comprises a ferromagnetic material;

photographic material having a unique design and secured to the substantially circular top flat surface of the golf ball marker, the photographic material comprising a flexible material;

wherein the disc of material is sized and shaped to match the base so that the disc of material extends continuously over the substantially circular top flat surface and to a periphery of the base and the disc of material being secured to the base using an adhesive applied to the substantially top flat surface of the base; and wherein the golf ball marker is configured to be used when a golfer is wearing the clothing having matching indicia to visually identify who the golf ball marker belongs to when playing a game of golf.

12. The golf ball marker of claim 11, wherein the photographic material is configured to have the digital image applied thereon by a printer.

* * * * *